United States Patent [19]

Shinoda et al.

[11] 4,106,456

[45] Aug. 15, 1978

[54] FUEL SUPPLY INSTALLATION FOR INTERNAL COMBUSTION ENGINES

[75] Inventors: Kazuo Shinoda; Masanori Torii, both of Toyota, Japan

[73] Assignee: Toyota Jidosha Kogyo Kabushiki Kaisha, Toyota, Japan

[21] Appl. No.: 715,145

[22] Filed: Aug. 17, 1976

[30] Foreign Application Priority Data

Mar. 16, 1976 [JP] Japan ..... 51-027681

[51] Int. Cl.[2] ..... F02M 29/00

[52] U.S. Cl. ..... 123/119 E; 123/122 AC; 123/133

[58] Field of Search ..... 123/119 E, 119 EE, 122 AC, 123/141, 32 AE, 139 AW; 261/DIG. 42, DIG. 48, DIG. 55

[56] References Cited

U.S. PATENT DOCUMENTS

| | | | |
|---|---|---|---|
| 1,939,302 | 12/1933 | Heaney | 123/119 E |
| 2,791,990 | 5/1957 | Grieb | 123/119 EE |
| 2,791,994 | 5/1957 | Grieb | 123/119 EE |
| 3,860,173 | 1/1975 | Sata | 123/119 E |
| 3,930,481 | 1/1976 | Eckert | 123/37 AE |
| 3,977,383 | 8/1976 | Nagumo | 123/141 |

*Primary Examiner*—Ronald H. Lazarus
*Attorney, Agent, or Firm*—Stevens, Davis, Miller & Mosher

[57] ABSTRACT

Disclosed is a fuel supply installation for internal combustion engines, in which fluid fuel is atomized by ultrasonic vibration and which includes a fuel atomization pail provided under the bottom wall of an intake air passage and which is open to the passage. The fuel atomization pail has an ultrasonic element which is energized by high frequency electric power. The fluid fuel in the atomization pail is atomized by ultrasonic vibration of the element and is mixed with the suction air in the intake passage.

16 Claims, 7 Drawing Figures

FUEL SUPPLY INSTALLATION FOR INTERNAL COMBUSTION ENGINES

This invention generally relates to a fuel supply installation for internal combustion engines and more particularly to a fuel supply installation in which fluid fuel is atomized by ultrasonic vibration.

Fuel supply installations using carburetors or fuel injection means are conventionally well known in the art.

In the carburetor-type fuel supply installations, in which fuel is atomized by Venturi negative pressure, the quantity of required fuel cannot be determined proportionally to the quantity of suction fuel, but is influenced by the other engine conditions, such as, for example, the remainder of atomization pressure or the engine vibration. Furthermore, the grains of atomized fuel are relatively large in diameter so that the fuel grains may remain and attach themselves onto the inner wall of an intake passage and, hence, it is difficult to obtain a precise air-fuel ratio throughout the entire range of R.P.M. (Revolutions Per Minute) of the engine. To overcome such defects, carburetor-type engines are generally provided with means for heating the suction mixture and promoting the fuel vaporization. This technique, however, results in an increase of $NO_x$ contained in the exhaust gas.

In the injection-type fuel supply installations, in which fuel is injected into an intake manifold by means of fuel injectors, the quantity of injected fuel in relation to the suction air is easily controlled. The grains of injected fuel are, however, relatively large in diameter so that the same problem as described above occurs.

Accordingly, it is a principal object of the present invention to provide a fuel supply installation for internal combustion engines, which will supply very fine fuel grains into an intake manifold and prevent the attaching of the fuel grains on the inner walls of the intake manifold so as to improve the combustion efficiency of the engine.

Another object of the present invention is to provide a fuel supply installation in which the quantity of supply fuel is correctly and discretionally controlled in relation to the quantity of suction air so as to maintain a constant air-fuel ratio of the mixture supplied to the engine combustion chambers.

These objects of the present invention will be readily evident from the following specification together with the accompanying drawings wherein.

Figure 1:
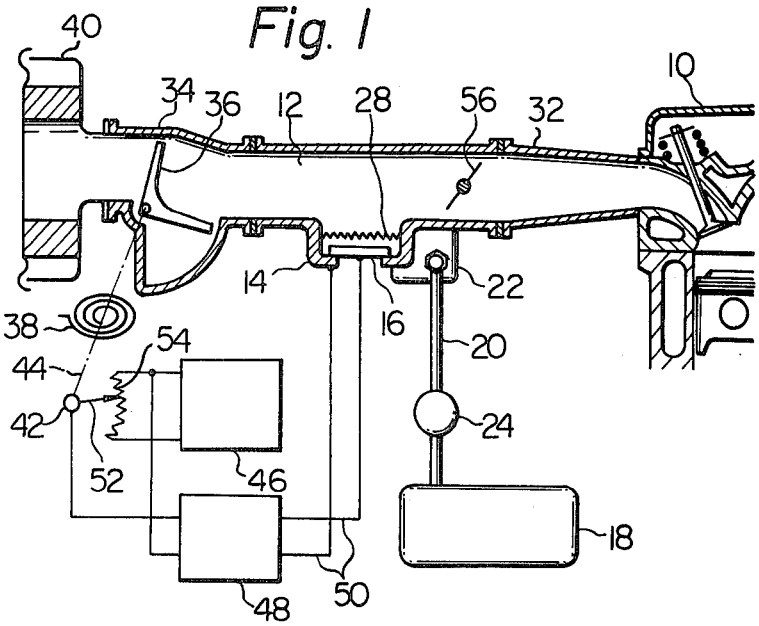
FIG. 1 is a schematic illustration of an embodiment of the present invention.

Referring now to the drawings, FIG. 1 illustrates an embodiment of a fuel supply installation according to this invention. An internal combustion engine 10 used in motor vehicles has a fuel atomization pail 14 which is provided under the bottom wall of an intake air passage 12 and is open to the passage. The fuel atomization pail 14 has an ultrasonic element 16 mounted on a bottom portion thereof. The ultrasonic element 16 is of the piezoelectric types, such as, for example, a piezoelectric element manufactured by the NGK SPARK PLUG CO. LTD. Magnetic strain type elements, however, can be also used.

The liquid fuel, namely gasoline, is supplied from a fuel tank 18 through a pipe 20 into a float chamber 22 by the help of a fuel pump 24. The fuel pump 24 may be either a mechanical diaphragm pump or an electric power pump.

Figure 2:
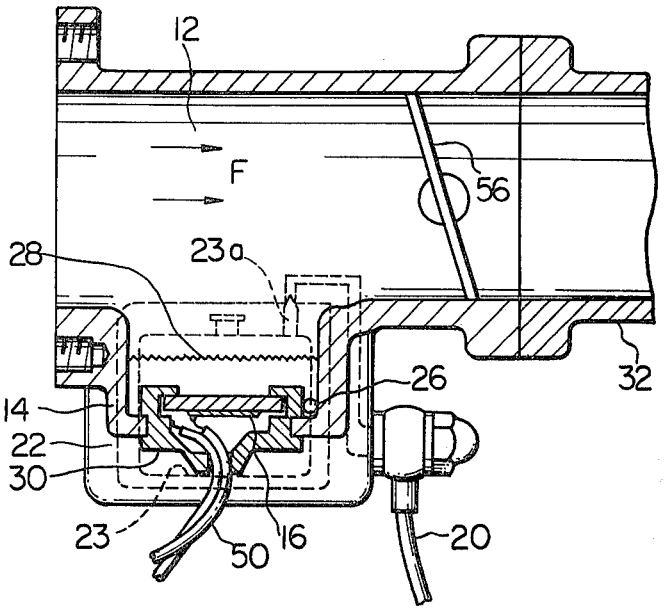
FIG. 2 is an enlarged cross-sectional view of the main portion of the embodiment shown in FIG. 1.

FIG. 2 is an enlarged cross-sectional view of a main portion of the fuel supply installation illustrated in FIG. 1. The float chamber 22 has a means for maintaining the fuel surface at a predetermined constant level. The maintaining means comprises a float member 23 and a needle valve **23*a* which are similar to those of conventional carburetor systems. The float chamber 22 communicates with the above-mentioned atomization pail 14 through a connecting port 26. As a result, the surface 28 of fluid fuel in the pail 14 is also maintained at a predetermined constant level. Such as atomization pail can be also located at a suitable position downstream of a throttle valve 56**.

Ultrasonic element 16 is mounted on a bottom portion of the fuel atomization pail 14 by means of a holder 30, which is made from a flexible material, such as, for example, rubber, which advantageously absorbs the vibration of the element 16. In FIG. 2, the ultrasonic element 16 generates ultrasonic vibration at high frequency (the frequency range is, for example, 1 to 2 MHz) and excites the fluid fuel in the atomization pail 14. As a result the fuel near the fluid surface 28 is atomized in the form of very fine grains and diffused into the intake air passage 12 upwardly from the fluid surface 28. The fuel diffused to the intake passage 12 is mixed with the suction air, the direction of which is indicated by arrow F in FIG. 2, and hence the air-fuel mixture is supplied to an engine combustion chamber through an intake manifold 32.

Figure 3:
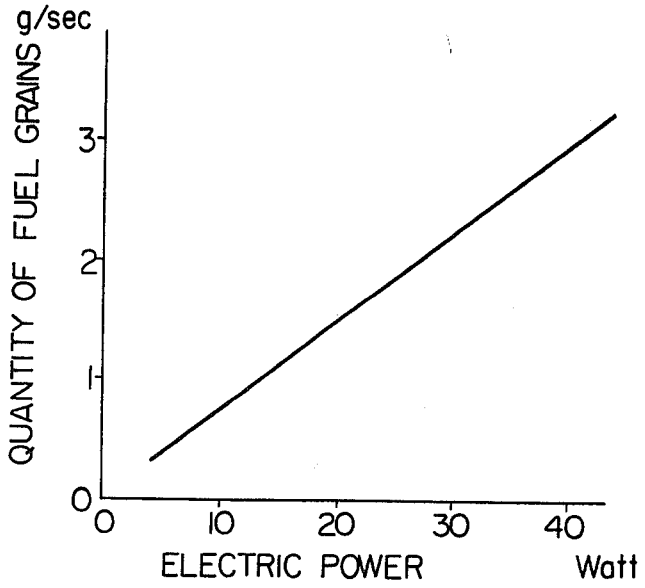
FIG. 3 is a graph showing the quantity of fuel grains generated in an intake manifold.

FIG. 3 is a graph, based on experiments conducted by the inventors, showing the relationship between the electric power (voltage) for energizing the ultrasonic element 16 and the quantity of fuel atomized by the element 16. As clearly shown in this graph, it was experimentally confirmed that the atomization fuel increases in quantity proportionately with the supplied electric power. This relationship was, however, realized under such a condition that a suitable air flow existed over the fluid surface 28.

Methods of energizing the ultrasonic element 16 will now be described. In FIG. 1, a suitable air-flow-meter 34 is provided in the intake air passage 12 between an air cleaner 40 and the atomization pail 14. The air-flow-meter 34 has a measuring plate 36 which is rotatably mounted and turned in accordance with the pressure of suction air from the air cleaner 40. The measuring plate 36 is maintained in such a position that the air pressure and the force of a spring 38 are balanced. The position of the measuring plate 36 is exclusively determined in accordance with the quantity of suction air, since the pressure of suction air increases proportionately to the quantity of suction air. A potentiometer 42 is mounted on a shaft (shown by a broken line) of the measuring plate 36. The potentiometer 42 divides electric power generated by a high frequency oscillator 46 in proportion to the quantity of suction air. The electric power thus measured is transmitted into the amplifier 48. The electric power, which is proportional to the quantity of suction air, is amplified by an amplifier 48 and transmitted to the ultrasonic element 16 by wires 50.

The quantity of generated fuel grains is proportional to the electric power for energizing the ultrasonic element 16, as above-mentioned. Therefore, a mixture of a constant air-fuel ratio can be obtained by a suitable election of the relationship between the rotational angle of a turning member 52 of the potentiometer 42 and a resistance 54. Generally speaking, the quantity of suction air changes in accordance with the opening area of the throttle valve 56. The quantity is, however, influenced by the engine revolutions and other engine conditions, such as the temperature of the engine cooling water. Therefore, it is not desirable that the ultrasonic element 16 be operated in relation to the opening of throttle valve 56.

Figure 4:
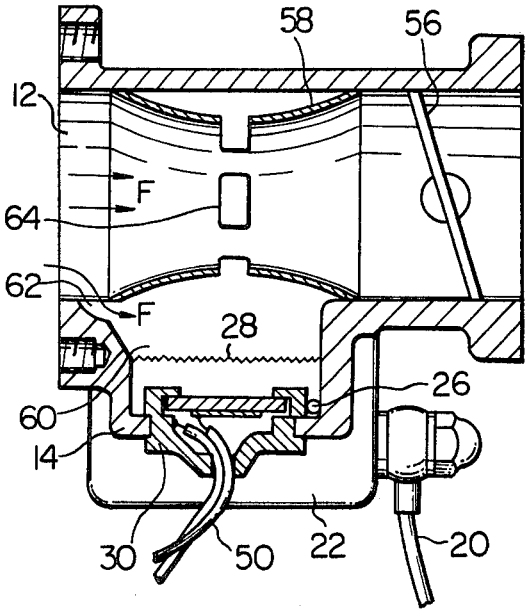
FIG. 4 is a view similar to FIG. 2 and showing another embodiment.

FIG. 4 is a view similar to FIG. 2 and shows another embodiment of the present invention. In this embodiment, an intake air passage 12 has a Venturi 58 and an atomization chamber 60 is provided under the Venturi 58. The suction air F from upstream of the Venturi 58 partially flows into the atomization chamber 60 through an inlet opening 62. As a result the fuel grains, which are diffused from the fuel surface 28, are forced to flow into the mixture passage 12 through mixing port 64. Flow of the suction air is accelerated by the Venturi 58 and the negative pressure thereof increases so that the mixing of the fuel grains with the suction air is performed more effectively than in the above-mentioned embodiment shown in FIG. 2. As a result a more homogeneous gas mixture is obtained.

Figure 5:
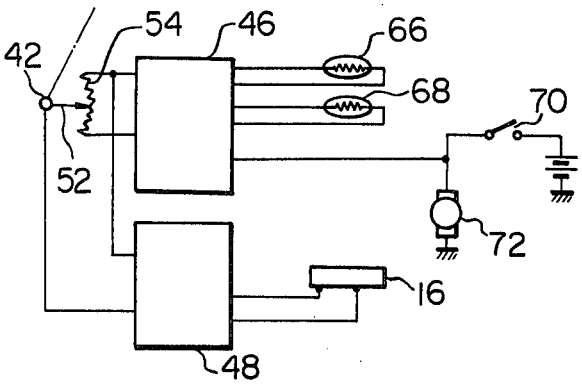
FIGS. 5 and 6 are block diagrams for explanation of the operations of an ultrasonic element.

FIG. 5 is a block diagram for explanation of the operation of the ultrasonic element 16. The electric power energizing the element 16 should be primarily determined in such a manner that it is proportional to the quantity of suction air, as above-mentioned. The electric power can be, however, also determined in consideration of other engine conditions, such as the temperature of the suction air or the temperature of the engine cooling water, and hence the quantity of fuel can be controlled in accordance with such conditions. In FIG. 5, the high frequency oscillator 46 has a thermistor 66 connected thereto, which detects the temperature of the engine cooling water and changes the electric power of the oscillator 46 in accordance with the changes of its resistance so as to increase the supply of fuel when the engine is cool. The oscillator 46 also has another thermistor 68 connected thereto, which detects the temperature of suction air. Then, the supply of fuel is adjusted to increase when the suction air is cool. Furthermore, an engine starting switch 70 is also connected to the oscillator 46. When the engine is in the starting condition, that is to say, the engine starter motor 72 is rotating, the electric power can be increased so as to increase the fuel supply.

Figure 6:
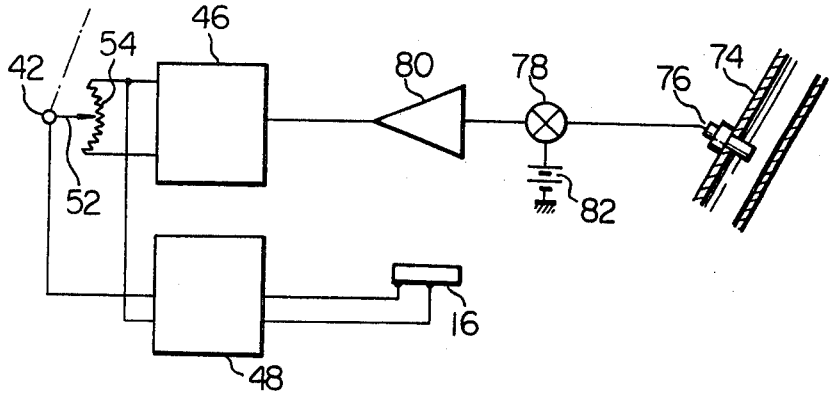
Figure 7:
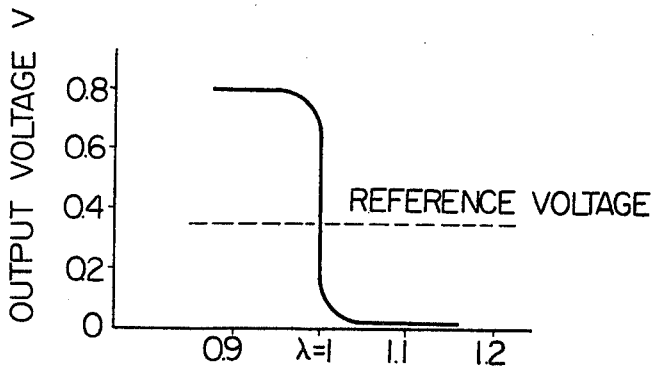
FIG. 7 is a graph showing the characteristics of an oxygen ($O_2$) sensor.

FIG. 6 is another block diagram in which the concentration of oxygen ($O_2$) contained in the exhaust gas is detected and the air-fuel ratio is controlled to be as comparison as possible to the theoretical air-fuel ratio by increasing or decreasing the fuel supply in accordance with the detected $O_2$ concentration. For this purpose, an exhaust pipe 74 has on the inner wall thereof an oxygen ($O_2$) sensor 76, which is connected to the high frequency oscillator 46 through a comparator 78 and an amplifier 80. The comparator 78 is given a constant reference voltage (such as 0.35 volt) by a battery 82. A characteristic curve of the $O_2$ sensor 76 is shown in FIG. 7. In this curve, if the comparision voltage is 0.35 volt, the output voltage of the $O_2$ sensor 76 abruptly decreases at $\lambda = 1$ (a theoretical air-fuel ratio is obtained at $\lambda = 1$). Therefore, in this embodiment, the $O_2$ concentration of the exhaust gas is fed back to the high frequency oscillator 46 and, hence, the fuel supply is controlled so as to obtain an air-fuel ratio as near as possible to the theoretical air-fuel ratio.

The advantages of the present invention are as follows.

(1) As the fluid fuel is atomized by ultrasonic vibration, very fine fuel grains are generated. Such fine fuel grains do not attach themselves to the inner walls of the intake passage so that the exact air-fuel ratio is obtained and the efficiency of engine combustion is improved throughout the entire range of R.P.M. of the engine.

(2) Controlling of the supply fuel is easily performed, because the quantity of fuel grains is proportional as to the electric power energizing the ultrasonic element. It is, therefore, possible to control and adjust the fuel supply so that it can be adapted to various engine conditions.

(3) Controlling of the supply fuel is rapidly accomplished and smooth engine rotation is obtained.

(4) The quantity of the fuel supply is not influenced by the height of the fluid fuel in the atomization pail because of the fuel atomization by the ultrasonic vibrations. As a result, the quantity of the fuel is exactly controlled. The suitable height of the fuel surface is less than 3 cm and more than 2 cm.

(5) It is possible to reduce the CO, HC and $NO_x$ contained in the exhaust gas by improvement of the efficiency of combustion. In a conventional carburetor-type engine, the evaporated fuel is directly introduced into the engine combustion chamber, so that the diameters of the fuel grains are nearly zero and, hence, a large amount of $NO_x$ is contained in the exhaust gas. In this invention, however, fine grains of atomized fuel are directly introduced into the engine combustion chambers, so that it is possible to reduce the $NO_x$ contained in the exhaust gas.

What is claimed is:

1. A fuel supply installation for an internal combustion engine in which fluid fuel is atomized by ultrasonic vibrations, said engine including a throttle valve located in an intake air passage, comprising:

a fuel atomization pail containing said fluid fuel provided in said intake air passage of said engine, said atomization pail being open to said air passage;

an ultrasonic element provided in said fuel atomization pail, said ultrasonic element generating high frequency ultrasonic vibrations when supplied with electric power, at least a portion of said element being soaked in the fluid fuel in said atomization pail;

suction air measuring means located in said intake air passage and upstream of said throttle valve; and means coupled to said suction air measuring means and to said ultrasonic element for controlling the electric power supplied to said ultrasonic element so as to be proportional to the quantity of suction air, whereby a quantity of fluid fuel which is proportional to the quantity of suction air is atomized from said atomization pail and introduced into said engine.

2. A fuel supply installation as set forth in claim 1 wherein said suction air measuring means comprises an air-flow-meter provided in the intake air passage at the upstream side of said atomization pail.

3. A fuel supply installation as set forth in claim 1, wherein said means for controlling the electric power supplied to said ultrasonic element comprises a high frequency oscillator for generating high frequency electric power, a potentiometer connected to said suction air measuring means and to said high frequency oscillator for dividing electric power generated by said high frequency oscillator in proportion to the quantity of suction air, and an amplifier for amplifying said electric power in proportion to the divided output power of said oscillator and for coupling the amplified electric power to said ultrasonic element.

4. A fuel supply installation as set forth in claim 3 wherein said installation further comprises a thermistor connected to said high frequency oscillator for detecting the temperature of engine cooling water, whereupon the supply of fuel is controlled so as to be increased when the engine is cool.

5. A fuel supply installation as set forth in claim 3, wherein said installation further comprises a thermistor connected to said high frequency oscillator for detecting the temperature of suction air, whereupon the supply of fuel is controlled so as to be increased when the suction air is cool.

6. A fuel supply installation as set forth in claim 3, wherein said installation further comprises means for detecting the rotation of an engine starting motor connected to said high frequency oscillator, whereupon the supply of fuel is controlled so as to be increased when said engine starting motor is rotating.

7. a fuel supply installation as set forth in claim 3, wherein said installation further comprises an oxygen ($O_2$) sensor provided on the inner wall of an exhaust passage and connected to said high frequency oscillator, whereupon the supply of fuel is controlled in such a manner that when said oxygen sensor indicates that the oxygen concentration of the exhaust gas is less than a predetermined constant value, the electric power being supplied to said ultrasonic element increases, and that when said oxygen sensor indicates that the oxygen concentration of the exhaust gas is more than the predetermined constant value, the electric power being supplied to said ultrasonic element decreases.

8. A fuel supply installation as set forth in claim 7 wherein said $O_2$ sensor is connected to the high frequency oscillator through a comparator, said comparator being supplied a constant reference voltage by a battery.

9. A fuel supply installation as set forth in claim 8 wherein said constant voltage is 0.35 volt.

10. A fuel supply installation as set forth in claim 1 wherein a venturi is formed in said intake air passage at the upper portion of said fuel atomization pail, said venturi having an inlet opening which allows at least a part of the suction air to flow into said fuel atomization chamber and mixing ports which allows the atomized fuel and said suction air to flow into said intake air passage.

11. A fuel supply installation as set forth in claim 1 wherein said ultrasonic element is of the piezoelectric type.

12. A fuel supply installation as set forth in claim 1 wherein said ultrasonic element is of the magnetic strain type.

13. A fuel supply installation as set forth in claim 1 wherein said ultrasonic element is mounted on a bottom portion of said fuel atomization pail by means of a holder which is made from a flexible material.

14. A fuel supply installation as set forth in claim 13 wherein said holder is made from rubber.

15. A fuel supply installation as set forth in claim 1 which further comprises means for maintaining the surface of fluid fuel in said atomization pail at a predetermined constant level.

16. A fuel supply installation for an internal combustion engine in which fluid fuel is atomized by ultrasonic vibrations, said engine including a throttle valve located in an intake air passage, comprising:

a fluid fuel tank;

a fuel atomization pail provided under the bottom wall of said intake air passage of said engine and open to said air passage;

means for supplying fluid fuel from said fuel tank into said fuel atomization pail;

means for maintaining the surface of fluid fuel in said atomization pail at a predetermined constant level;

an ultrasonic element provided in said fuel atomization pail, at least a portion of said element being soaked in the fluid fuel in the atomization pail;

means for supplying electric power to said ultrasonic element, said ultrasonic element being energized by said electric power and generating high frequency ultrasonic vibrations;

suction air measuring means provided in said intake air passage and upstream of said throttle valve, and;

means for controlling said electric power so as to be proportional to the quantity of suction air, whereby a quantity of fluid fuel which is proportional to the quantity of suction air is atomized from said atomization pail and introduced into the combustion chambers of said engine.

* * * * *